US006393782B1

(12) United States Patent
Berridge et al.

(10) Patent No.: US 6,393,782 B1
(45) Date of Patent: May 28, 2002

(54) STACKABLE WALL PANEL SYSTEM

(75) Inventors: Philip Longstreet Berridge, Allendale; Scott Walter Compton, Grand Haven; Bruce Robert Gezon, Caledonia; Anthony David Lufkin, Paw Paw; Shane Michael Ramsdell, Lowell, all of MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/585,967

(22) Filed: Jun. 2, 2000

Related U.S. Application Data

(60) Provisional application No. 60/137,809, filed on Jun. 4, 1999.

(51) Int. Cl.[7] ..... E04H 1/00

(52) U.S. Cl. ..... 52/239; 52/238.1; 52/240; 52/241; 52/243; 52/220.7; 52/586.1; 52/800.11

(58) Field of Search ..... 52/239, 238.1, 52/240, 241, 243, 36.5, 243.1, 220.7, 584.1, 586.1, 800.11, 236.3, 236.7, 726.1, 726.3, 762, 653.1; 160/135

(56) References Cited

U.S. PATENT DOCUMENTS

| | | | |
|---|---|---|---|
| 2,970,677 | A | 2/1961 | Springs, Jr. et al. |
| 3,066,770 | A | 12/1962 | Millard et al. |
| 3,180,459 | A | 4/1965 | Liskey, Jr. |
| 3,228,157 | A | 1/1966 | Jacobson |
| 3,261,625 | A | 7/1966 | Cripe |
| 3,370,389 | A | 2/1968 | Macaluso |
| 3,430,997 | A | 3/1969 | Propst et al. |
| 3,477,492 | A | 11/1969 | Suess |
| 3,486,287 | A | 12/1969 | Guillon |
| 3,517,467 | A | 6/1970 | Propst et al. |
| 3,546,834 | A | 12/1970 | Murawski |
| 3,550,337 | A | 12/1970 | Lorenz |

(List continued on next page.)

FOREIGN PATENT DOCUMENTS

WO WO 99/34069 A1 7/1998

OTHER PUBLICATIONS

"Ethospace Interiors Planning Guide, 1st Edition," Herman Miller, Source Book © 1985, pp. 1–107.
"Action Office® Planning Guide Series 2 Panels," Herman Miller Planning Guide, 07/91.
"Action Office® Series 3 Panels," Herman Miller Planning Guide, 01/93.

*Primary Examiner*—Beth A. Stephan
*Assistant Examiner*—Dennis L. Dorsey
(74) *Attorney, Agent, or Firm*—Brinks Hofer Gilson & Lione

(57) ABSTRACT

A stackable wall panel system including at least one upper and lower wall panel and a first and second post. The second post is disposed on the first post. One or more upper wall panels are connected to a pair of lower wall panels having a rail with a pair of draw blocks and a draw rod.

26 Claims, 8 Drawing Sheets

U.S. PATENT DOCUMENTS

| | | | |
|---|---|---|---|
| 3,553,916 | A | 1/1971 | Lickliter et al. |
| 3,621,635 | A | 11/1971 | DeLange |
| 3,691,709 | A | 9/1972 | Ostborg |
| 3,745,732 | A | 7/1973 | Pritchard et al. |
| 3,789,567 | A | 2/1974 | Rae et al. |
| 3,987,836 | A | 10/1976 | LeMay |
| 4,030,219 | A | 6/1977 | Donovan |
| 4,056,903 | A | 11/1977 | Guarnere |
| 4,104,838 | A | 8/1978 | Hage et al. |
| 4,120,124 | A | 10/1978 | Temple et al. |
| 4,245,442 | A | 1/1981 | Durham |
| 4,308,695 | A | 1/1982 | Ehrsam |
| 4,391,069 | A | 7/1983 | Vermillion |
| 4,391,073 | A | 7/1983 | Mollenkopf et al. |
| 4,406,101 | A | 9/1983 | Heidmann |
| 4,434,596 | A | 3/1984 | McAteer et al. |
| 4,448,003 | A | 5/1984 | Hasbrouck |
| 4,535,577 | A | 8/1985 | Tenser et al. |
| 4,545,168 | A | 10/1985 | Dalton, Jr. |
| 4,557,091 | A | 12/1985 | Auer |
| 4,571,907 | A | 2/1986 | DeFouw et al. |
| 4,573,513 | A | 3/1986 | Small et al. |
| 4,601,146 | A | 7/1986 | Harter et al. |
| 4,625,476 | A | 12/1986 | Shimada |
| 4,631,881 | A | 12/1986 | Charman |
| 4,644,993 | A | 2/1987 | Cooper et al. |
| 4,709,517 | A | 12/1987 | Mitchell et al. |
| 4,712,336 | A | 12/1987 | Backer |
| 4,716,699 | A | 1/1988 | Crossman et al. |
| 4,719,730 | A | 1/1988 | Winkowski |
| 4,771,583 | A | 9/1988 | Ball et al. |
| RE32,890 | E | 3/1989 | DeFouw et al. |
| 4,821,477 | A | 4/1989 | Rydqvist |
| 4,821,788 | A | 4/1989 | Nelson |
| 4,860,812 | A | 8/1989 | DePietro et al. |
| 4,881,349 | A | 11/1989 | Nelson |
| 4,905,334 | A | 3/1990 | Oppenhuizen |
| 4,905,428 | A | 3/1990 | Sykes |
| 4,907,384 | A | 3/1990 | Underwood |
| 4,914,873 | A | 4/1990 | Newhouse |
| 4,914,878 | A | 4/1990 | Tamaki et al. |
| 4,936,066 | A | 6/1990 | Rutsche et al. |
| 4,947,601 | A | 8/1990 | McGuire |
| 4,962,805 | A | 10/1990 | Allen |
| 4,993,205 | A | 2/1991 | Dull et al. |
| 5,009,043 | A | 4/1991 | Kurrasch |
| 5,025,603 | A | 6/1991 | Johnson |
| 5,038,539 | A | 8/1991 | Kelley et al. |
| 5,056,285 | A | 10/1991 | Frascaroli et al. |
| 5,056,577 | A | 10/1991 | DeLong et al. |
| 5,058,347 | A | 10/1991 | Schuelke et al. |
| 5,060,434 | A | 10/1991 | Allison |
| 5,062,246 | A | 11/1991 | Sykes |
| 5,065,556 | A | 11/1991 | DeLong et al. |
| 5,067,294 | A | 11/1991 | McGowan |
| 5,069,263 | A | 12/1991 | Edwards |
| 5,070,666 | A | 12/1991 | Looman |
| 5,088,541 | A | 2/1992 | Persing et al. |
| 5,134,826 | A | 8/1992 | LaRoche et al. |
| 5,159,793 | A | 11/1992 | Duego et al. |
| 5,174,086 | A | 12/1992 | Payne et al. |
| 5,175,969 | A | 1/1993 | Knauf et al. |
| 5,216,859 | A | 6/1993 | Moreno et al. |
| 5,251,413 | A | 10/1993 | Goodman |
| 5,274,970 | A | 1/1994 | Roberts |
| 5,277,005 | A | 1/1994 | Hellwig et al. |
| 5,277,007 | A | 1/1994 | Hellwig et al. |
| 5,285,602 | A | 2/1994 | Felton |
| 5,287,666 | A | 2/1994 | Frascaroli et al. |
| 5,305,567 | A | 4/1994 | Wittler |
| 5,377,461 | A | 1/1995 | DeGrada et al. |
| 5,382,719 | A | 1/1995 | Fagan |
| 5,394,558 | A | 2/1995 | Arakawa et al. |
| 5,394,658 | A | 3/1995 | Schreiner et al. |
| 5,394,668 | A | 3/1995 | Lim |
| 5,400,560 | A | 3/1995 | Hellwig et al. |
| 5,406,760 | A | 4/1995 | Edwards |
| 5,430,984 | A | 7/1995 | Young et al. |
| 5,433,046 | A | 7/1995 | MacQuarrie et al. |
| 5,487,246 | A | 1/1996 | Hodges et al. |
| 5,490,357 | A | 2/1996 | Lin |
| 5,491,943 | A | 2/1996 | Vondrejs et al. |
| 5,546,718 | A | 8/1996 | Way |
| 5,561,960 | A | 10/1996 | Minnick et al. |
| 5,562,469 | A | 10/1996 | Nienhuis et al. |
| 5,586,593 | A | 12/1996 | Schwartz |
| 5,600,926 | A | 2/1997 | Ehrlich |
| 5,603,370 | A | 2/1997 | Boer |
| 5,634,305 | A | 6/1997 | Erlanger |
| 5,638,650 | A | 6/1997 | Edwards |
| 5,638,653 | A | 6/1997 | Rossi |
| 5,642,593 | A | 7/1997 | Shieh |
| 5,644,878 | A | 7/1997 | Wehrmann |
| 5,657,885 | A | 8/1997 | White et al. |
| 5,682,719 | A | 11/1997 | Huang |
| 5,687,859 | A | 11/1997 | Miller |
| 5,692,345 | A | 12/1997 | Mogaki et al. |
| 5,724,779 | A | 3/1998 | Chang |
| 5,737,887 | A | 4/1998 | Smeenge |
| 5,737,893 | A | 4/1998 | Rossiter et al. |
| 5,746,034 | A | 5/1998 | Luchetti et al. |
| 5,746,035 | A | 5/1998 | Seiber et al. |
| 5,802,789 | A | 9/1998 | Goodman et al. |
| 5,806,258 | A | 9/1998 | Miedema et al. |
| 5,809,714 | A | 9/1998 | Kurrasch et al. |
| 5,809,715 | A | 9/1998 | Tanaka |
| 5,839,240 | A | 11/1998 | Elsholz et al. |
| 5,852,904 | A | 12/1998 | Yu et al. |
| 5,867,955 | A | 2/1999 | Russell |
| 5,870,867 | A | 2/1999 | Mitchell |
| 5,896,710 | A | 4/1999 | Hoyle |
| 5,899,025 | A | 5/1999 | Casey et al. |
| 5,899,035 | A | 5/1999 | Waalkes et al. |
| 5,918,422 | A | 7/1999 | Bucher, Jr. |
| 5,930,963 | A | 8/1999 | Nichols |
| 5,974,742 | A | 11/1999 | Schreiner et al. |
| 6,000,179 | A | 12/1999 | Musculus et al. |
| 6,003,273 | A | 12/1999 | Elsholz et al. |
| 6,009,675 | A | 1/2000 | Waalkes et al. |
| 6,009,676 | A | 1/2000 | Feldpausch et al. |
| 6,047,509 | A | 4/2000 | Savoie |
| 6,052,958 | A | 4/2000 | Miedema et al. |

STACKABLE WALL PANEL SYSTEM

This application claims the benefit of U.S. Provisional Application No. 60/137,809 filed Jun. 4, 1999, which application is hereby incorporated herein by reference.

BACKGROUND OF THE INVENTION

The present invention relates generally to a wall panel system, and in particular, to stackable wall panel system comprised of upper wall panels disposed on and overlying lower wall panels.

Panel systems are commonly used to divide large, open office space into separate workspaces. For example, Herman Miller, Inc., the assignee of the present application, manufacturers and sells two such work space management systems: the ACTION OFFICE® system and the ETHOSPACE® system. Typically, workspace management systems are comprised of a series of wall panels arranged in various configurations. For example, wall panels can be connected in series in an end-to-end configuration, or they can be arranged around and connected to a corner post in a two-way, three-way or four-way configuration. Often, it is desirable to provide wall panels of differing heights so as to allow the user of the workspace to have flexibility in configuring the workspace. For example, shorter wall panels can be used to ease and promote communication with a user of the workspace, e.g., at a reception area. Conversely, taller wall panels can be used to provide greater privacy for the user.

In other systems, upper wall panels can be arranged above lower wall panels so as to allow the user to reconfigure the workspace. In this way, the height of a wall panel defining in part the workspace can be altered with stackable upper wall panels, rather than removing entirely a lower wall panel and replacing it with a taller or shorter wall panel. Often, however, the addition or removal of stackable upper wall panels can involve complex, multiple parts and require excessive amounts of time and manpower to effect the necessary or desired change.

SUMMARY OF THE INVENTION

Briefly stated, one aspect of the invention is directed to an improved system of wall panels, including at least one upper and lower wall panel. The lower wall panel includes a top, a bottom and opposite ends. A rail having opposite ends is attached to the top of the lower wall panel. A lower draw block is engaged with one end of the rail. The upper wall panel overlies the lower wall panel and includes a draw surface formed on an end thereof. In a preferred embodiment, the draw surface is formed on the end of a hanger bracket attached to an end of the upper wall panel. An upper draw block having at least one draw surface engaging the draw surface of the upper wall panel. A draw rod extends between and connects the upper and lower draw blocks.

In a preferred embodiment, a bottom of the upper wall panel engages the rail on the lower wall panel. Preferably, the bottom of the upper wall panel has a channel shaped to receive the rail.

In another aspect, a second upper wall panel overlies a first upper wall panel. The first upper wall panel includes a rail attached to a top thereof. A draw block is engaged with an end of the rail. The second upper wall panel includes a draw surface that is engaged with a draw block. A draw rod extends between and connects the draw block attached to the first upper wall panel and to the upper draw block engaging the draw surface of the second upper wall panel.

In yet another aspect, a lower wall panel is connected to a first post, while one or more upper panels are connected to a second post, which is attached to and extends upwardly from the first post. In a preferred embodiment, the second post includes one or more draw surfaces and the one or more upper wall panels are connected to the second post with one or more draw blocks.

In yet another aspect, a first and second upper wall panel can be connected in an end-to-end configuration overlying a first and second lower wall panel connected in an end-to-end configuration. The first and second lower wall panels each include a rail attached to a top thereof, with a lower draw block extending between and engaging an end of each rail at the interface of the first and second lower wall panels. The upper wall panels each include a draw surface that is engaged with a draw block. A draw rod extends between and connects the upper and lower draw block so as to secure the upper wall panels to each other and to the lower wall panels.

The present invention provides significant advantages over other wall panel systems. In particular, the upper wall panel can be easily and quickly installed on a lower wall panel and can be easily connected to a post, an adjacent upper wall panel or an adjacent lower wall panel, thereby providing the user with the ability to easily reconfigure a workspace by adding or removing stackable upper wall panels. Moreover, the upper wall panel can be installed without having to disassemble the connection between the lower wall panels, or between a lower wall panel and the post. In addition, the upper wall panels can be stacked two-high, or even higher, thereby providing even greater flexibility in reconfiguring the workspace. The present invention, together with further objects and advantages, will be best understood by reference to the following detailed description taken in conjunction with the accompanying drawings.

DETAILED DESCRIPTION OF THE PRESENTLY PREFERRED EMBODIMENTS

Figure 1:
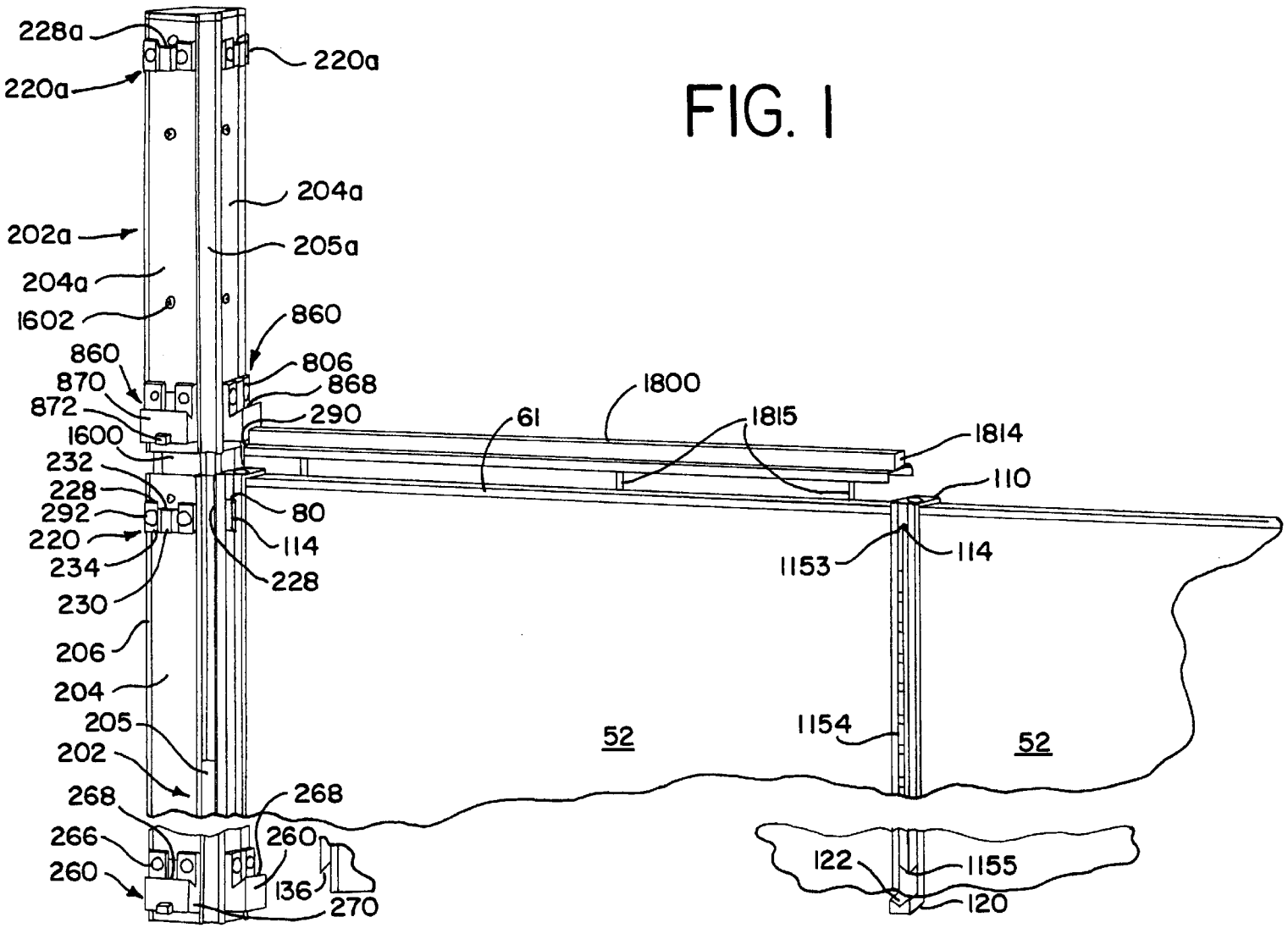
FIG. 1 is an exploded perspective view of a first and second post and a pair of lower wall panels, partially cut away, connected in an end-to-end configuration with a rail being attached to a top of one of the lower wall panels.
Figure 3:
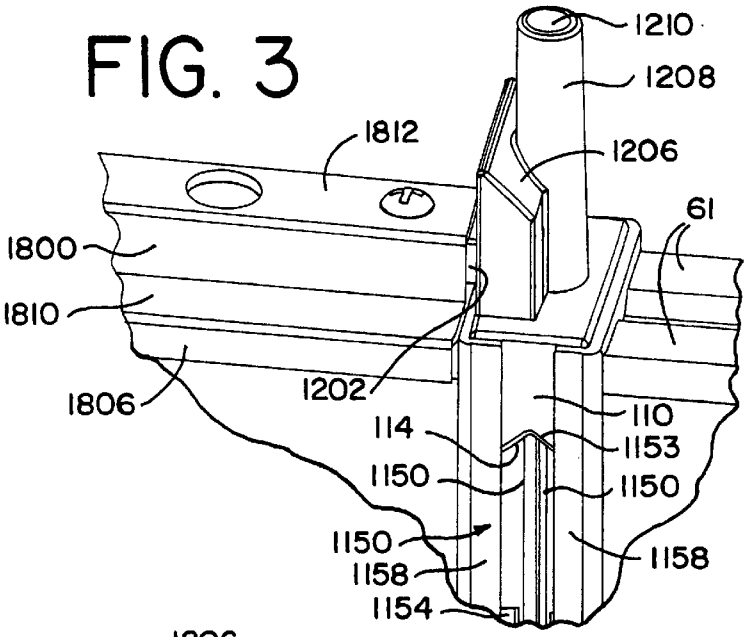
FIG. 3 is an enlarged perspective view of the lower draw block engaged with an end of the rail.
Figure 2:
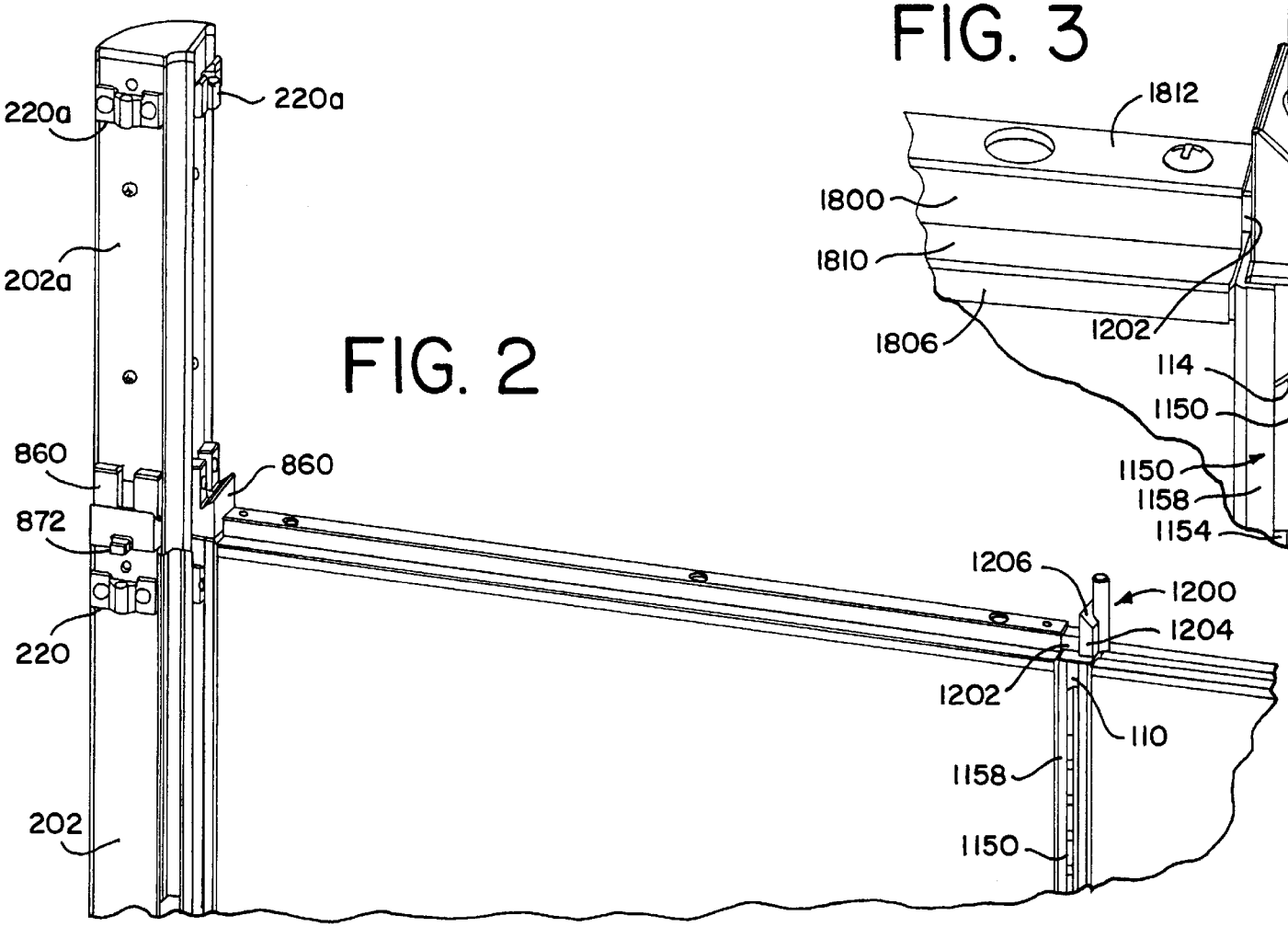
FIG. 2 is a perspective view of the lower wall panels and the first and second post with a lower draw block being inserted in the rail attached to the top of one of the lower wall panels.

Referring to the drawings, FIGS. 1–3 show a stackable wall system including a pair of lower wall panels 52 connected to one another in an end-to-end configuration, with one of the lower wall panels further connected to a corner post with a connector system 200. One connector system for connecting the lower wall panels to one another is disclosed in U.S. Pat. Nos. 3,430,997 and 3,517,467, which issued Mar. 4, 1969 and Jun. 30, 1968 respectively and were assigned to Herman Miller, Inc., the same assignee as for the present application, and both of which are hereby incorporated herein by reference. Another suitable connector system, which further shows a panel connected to a corner post with a connector system, is disclosed in U.S. Pat. No. 5,058,347, issued Oct. 22, 1991 and also assigned to Herman Miller, Inc., and which is also hereby incorporated herein by reference. Also incorporated herein by reference is U.S. Provisional Application No. 60/137,807, entitled "Stackable Wall Panel System," filed Jun. 4, 1999 and naming the same inventors named on this application.

Referring to FIG. 1, the corner post includes a post 202 configured as a tube. As shown in FIG. 1, the post includes two substantially planar connecting sides 204 formed at substantially right angles and joined with outer convex surface 206 and an inner concave surface 205. As so configured, the post 202 is intended to connect a pair of lower wall panels extending at right angles therefrom. Alternatively, the post can be configured with two substantially planar connecting sides oriented parallel to another on opposite sides of the post for joining two lower wall panels in an end-to-end (straight line) configuration. The connecting sides are preferably connected with similarly planar exposed sides, which can be further covered with fabric or a separate cover member. In yet another alternative, the post is provided with three substantially planar connecting sides formed at substantially right angles to each other, with a fourth exposed side, for interconnecting three lower wall panels. In another embodiment, the post is provided with four substantially planar connecting sides, each of which is connected to a lower wall panel extending therefrom. In this way, different embodiments of the post can be provided to connect two or more panels in various two-way, three-way, or four-way configurations, and preferably the post can connect two, three, or four panels at various right angles to, or in line with, each other.

In any of the aforementioned embodiments, an upper wedge block 220 is mounted to each connecting side of the tube with a pair of fasteners 292. The upper wedge block has a mounting base 238 and a wedge or draw surface 228, and screw holes 234. Preferably, the draw surface 228 is upwardly inclined, preferably at an angle of about 45 degrees, and is planar. In addition, the base includes a threaded arcuate extension 230 having a threaded receiving opening 232. Alternatively, the base can be configured with a male threaded stud extending upwardly from the base, rather than a female threaded receiving opening.

A lower draw block 260 is mounted to each connecting side of the tube along a bottom portion thereof below the upper wedge block 220. The lower draw block 260 includes a base 270 and screw holes 266. The lower draw block further includes a draw portion having an upwardly extending wedge or draw surface 268. The draw surface 268 is preferably upwardly inclined, preferably at an angle of 45 degrees to the vertical, and is planar.

Referring to FIGS. 14–17, one embodiment of a pair of lower wall panels 52 arranged in an end-to-end configuration is shown. An upper wedge block 70 is attached to each end of each lower wall panel along an upper portion thereof with a plurality of screws. The upper wedge block 70 includes a base 88 having a wedge or draw surface 80, which is preferably upwardly inclined and planar, and more preferably upwardly inclined at an angle of about 45 degrees, although it should be understood that other angles would also work. The draw block further includes a shaft receiving channel 84.

A lower wedge block 130 is attached to each end of each lower wall panel 52 below the upper wedge block 70 with a pair of screws. The lower wedge block 130 includes a base 142 with a wedge or draw surface 136, preferably downwardly inclined and planar, and more preferably at downwardly inclined at an angle of about 45 degrees, although it should be understood that other angles would also work. The draw block 130 further includes a shaft receiving channel 132.

A shell 1400 having a U-shaped channel configuration with a base 1402 and upstanding flanges 1404 is attached to each end of the lower panel. The shell 1400 is preferably made of metal, such as steel, although other materials would also work. A frame hanger, or hanger bracket 150 is disposed in the channel of the shell between the upper and lower wedge blocks and is attached to each end of the lower panel with fasteners, which extend through the shell 1400. The hanger bracket is preferably made of steel or like material and is preferably roll formed. The hanger bracket 150 is preferably W-shaped in cross-section and includes a pair of inwardly facing channels 151 and an outwardly facing channel 156 formed therebetween. End slots 152 are formed in front surfaces 160 of the channels 151, while accessory slots 154 are spaced along a side flange 162 of the anger bracket that extends outwardly and backwardly from the front surfaces 160, or at the corner interfacing the side flange and the adjacent front surface. Accessories such as shelving, overhead cabinets and the like are configured to engage the slots 152 in the side flanges of the hanger brackets.

In a preferred alternative embodiment, shown in FIGS. 1–4, 10, 18 and 19, the hanger bracket 1150 has draw surfaces 1155, 1153 formed along a bottom and top portion of the hanger bracket and that are inclined downwardly and upwardly respectively. The draw surfaces are preferably inclined at an angle of about 45 degrees, although other angles would also work. In this preferred embodiment, the wall panels do not include any wedge blocks. However, it should be understood that the term "wedge block" refers to the end portions of the hanger bracket that have draw surfaces operative to engage a mating draw block having complimentary draw surfaces.

Figure 11:
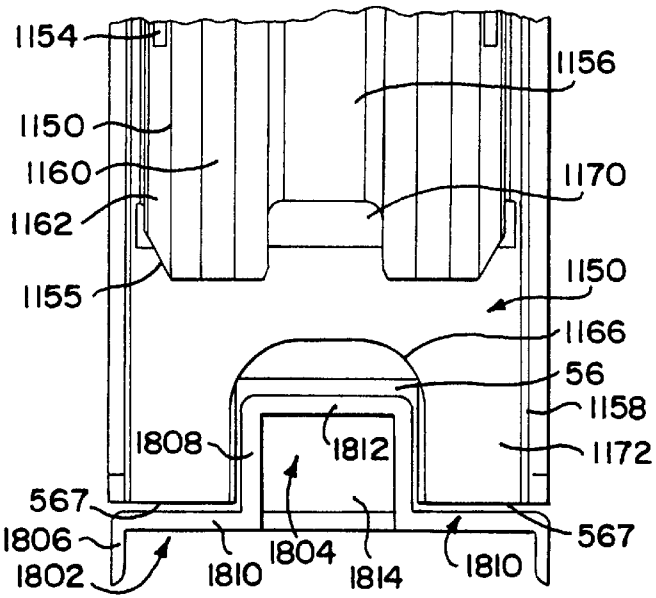
FIG. 11 is an enlarged partial end view of the upper wall panel shown in FIG. 10.
Figure 18:
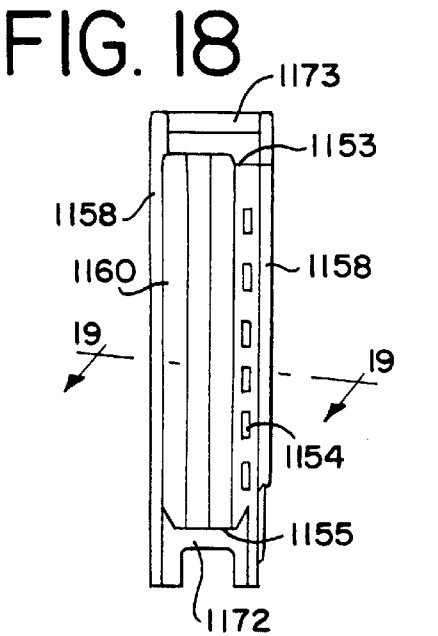
FIG. 18 is perspective view of an alternative embodiment of the hanger bracket.
Figure 19:
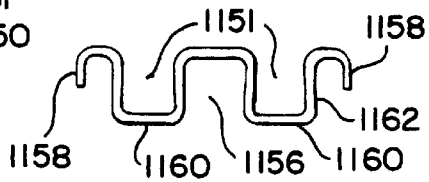
FIG. 19 is a cross-sectional view of the hanger bracket taken along line 19—19 in FIG. 18.

As best shown in FIGS. 18 and 19, the hanger bracket 1150 is preferably roll formed and includes inwardly facing channels 1151, outwardly facing channel 1156 formed therebetween and flanges 1158, which serve the function of the flanges 1404 of the shell. End slots 1152 are formed in front surfaces 1160 of the channels 1151, while accessory slots 1154 are spaced along a side flange 1162 that extends from the front surface 1160, or at the interface between the side flange and the front surface. Accordingly, in this embodiment, an underlying cosmetic shell is not required to provide the improved aesthetics. As best shown in FIG. 11, an opening 1170 is formed below the draw surfaces 1155 near the bottom end of the hanger bracket. Bottom and top plate portions 1172, 1173 extend between the flanges 1158 at opposite ends of the hanger bracket below and above the draw surfaces, respectively. The plates can be formed during the roll form process and thereafter welded along a middle portion thereof, or they can be made of separate pieces welded to the bottom and top of the hanger bracket, respectively.

Figure 17:
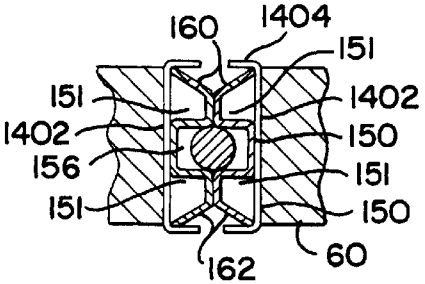
FIG. 17 is a cross-sectional view taken along line 17—17 in FIG. 16.
Figure 15:
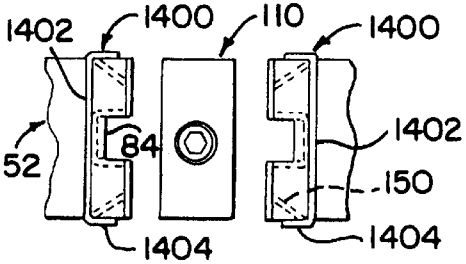
FIG. 15 is a top view of the lower wall panels and connector system shown in FIG. 14.

Referring to FIG. 17, the wall panels 52 are preferably comprised of a frame 60 constructed around the edges of the panel, which is covered with rectangular side faces. In a preferred embodiment, the frame includes an upper and lower horizontal frame member connected with a pair of vertical side frame members at their respective ends. A core filler, preferably a honeycomb material, is installed inside the frame between the side faces. A top surface 61 is formed along the top of the wall panel. A fabric can be applied over the side faces, and a flame retardant scrim can further be positioned between the fabric and the side face.

Figure 16:
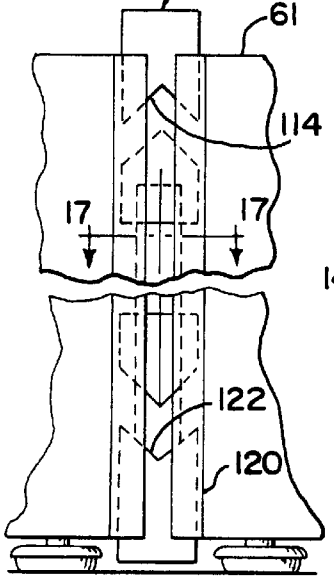
FIG. 16 is a side view of the lower wall panels of FIG. 14 having adjacent ends in abutment but with the connector system disengaged.
Figure 14:
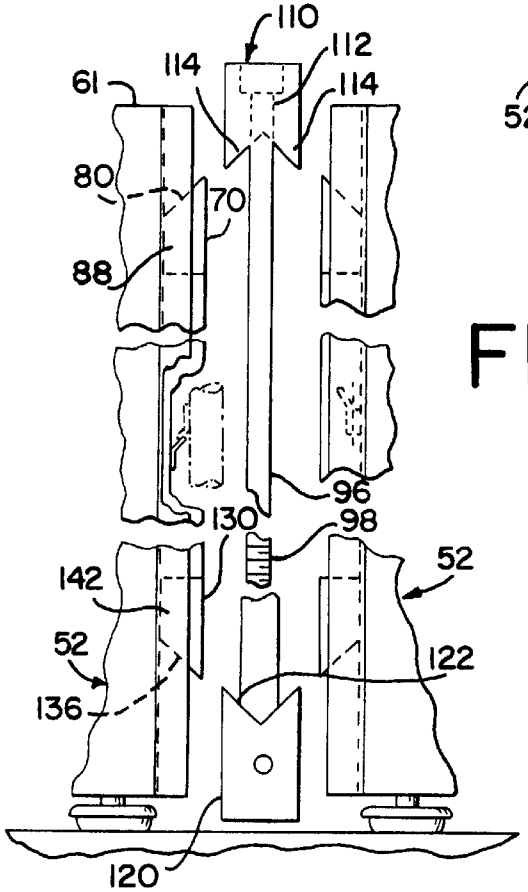
FIG. 14 is an exploded view of a pair of lower wall panels with a connector system.

Referring to one embodiment of a connector system for a pair of lower wall panels arranged in an end-to-end configuration, as shown in FIG. 16, an upper draw block 110 has a pair of downwardly inclined draw surfaces 114 and an opening 112. The draw surfaces 114 are complementary to and are engaged with the draw surfaces 80 of adjacent upper wedge blocks or the draw surfaces of the upper ends of adjacent hanger brackets secured to the lower wall panels 52. Preferably, the draw surfaces are planar and are formed at a complimentary angle to the draw surfaces of the wall panels, e.g., at 45 degrees to the vertical (or 90 degrees to each other) in the preferred embodiment. A lower draw block 120 similarly includes a pair of upwardly inclined draw surfaces 122, preferably planar and formed at a 45 degree to the vertical complementary angle with the draw surfaces of the wall panels. The lower draw block includes a female threaded bore or opening 121. In preferred embodiment, the lower draw block includes an upwardly extending post, or annular receiving member defining said opening. Alternatively, the post can be configured as a male threaded component, such as a stud. The draw surfaces 122 of the lower draw block are complementary to and are engaged with the draw surfaces 136 of the lower wedge blocks.

In a preferred embodiment, shown in FIGS. 1 and 3, the draw surfaces 114 of the upper draw block 110 engage the draw surfaces 1153 formed on the abutting hanger brackets of the adjacent ends of the respective lower wall panels, while the draw surfaces 122 of the lower draw block 120 engages the draw surfaces 1155 formed on the abutting hanger brackets.

A draw rod 90 comprising a shaft 96 extends through the opening 112 in the upper draw block and includes a threaded lower end 98 that threadably engages the bore 121 in the lower draw block. A head portion 94 of the draw rod is received in a recess 113 formed in the top of the upper draw block and engages a surface formed in the bottom thereof. The head 94 has a hex shaped recess formed therein that is shaped to receive an Allan wrench or like tool. The draw rod 90 is rotated so as to threadably engage the lower draw block and thereby draw the pair of lower wall panels together as the draw surfaces 114, 122 of the upper and lower draw blocks engage the complementary draw surfaces 80, 136 on the upper and lower wedge blocks, or the complementary draw surfaces 1153, 1155 on the abutting hanger brackets, respectively.

An alternative embodiment of the draw rod assembly is shown in U.S. Pat. No. 3,517,467, which was incorporated herein by reference above.

Referring to FIG. 1, the lower wall panels are connected to the corner post by engaging the draw surface 136 of the lower wedge block 120, or the draw surface 1155 on the bottom end of the hanger bracket mounted to the lower wall panel, with the complementary draw surface 268 of the lower draw block 260 mounted to the post 202. The draw surfaces 114 of an upper draw block are then engaged with the complementary draw surfaces 80, 228 of the upper wedge blocks on the adjacent corner post and lower wall panel, or with the complementary draw surfaces 1155 on the hanger bracket. A draw bolt 290, or short draw rod, is then passed through the opening 110 of the upper draw block and threadably engages the threaded opening 232 in the upper wedge block. The draw rod 290 is rotated so as to draw the lower wall panel 52 to the corner post as the complementary draw surfaces engage.

Notwithstanding the above description of the connector system used to connect the lower wall panels and corner post, it should be understood that the lower wall panels could be connected to one another, or to the corner post, in any number of ways not specifically described herein.

Figure 6:
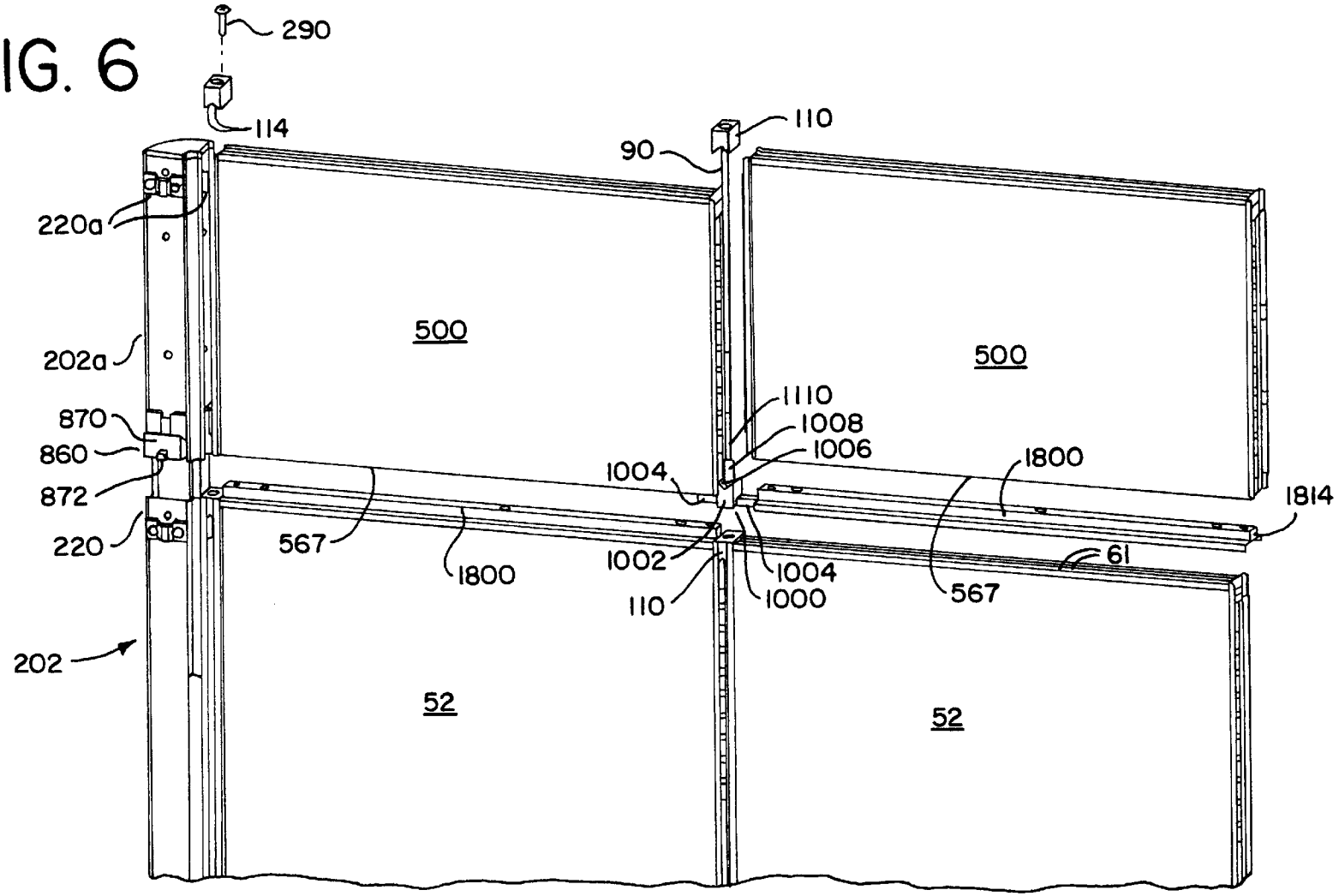
FIG. 6 is an exploded perspective view of a pair of upper wall panels being connected in an end-to-end configuration as they overlie a pair of lower wall panels.

Now referring to FIG. 6, wherein the pair of lower wall panels 52 connected in an end-to-end configuration are preferably connected in the manner described above with reference to FIGS. 1 and 13–17, and one of the lower wall panels 52 is connected to the corner post in the manner described above with reference to FIG. 1, a pair of upper wall panels 500 are shown in an overlying position with the pair of lower wall panels 52 arranged in the end-to-end configuration.

Figure 9:
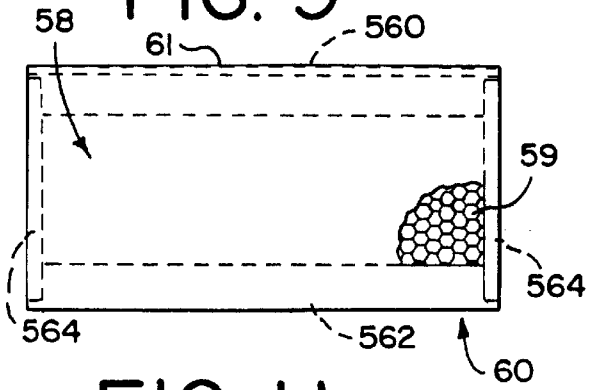
FIG. 9 is a side view of one embodiment of an upper wall panel core shown in partial cut-away.

In one embodiment, shown in FIG. 9, the upper wall panel 500 has a construction similar to the lower wall panel described above, and in particular, includes a core comprised of a frame 60, preferably made of wood, surrounding a honeycomb filler 59, preferably made of cardboard, with a pair of side faces 58, preferably made of hardboard, applied to each side of the frame over the filler. A fabric overlay can be then applied over the side faces. In addition, a flame retardant scrim can be disposed between the fabric and side faces. The frame 60 is constructed from an upper and lower horizontal frame member 560, 562 and a pair of side vertical frame members 564 joined at the corners of the frame. A cap can be installed on the exposed top of the either the upper or lower wall panel when it is not further supporting another upper wall panel.

Figure 10:
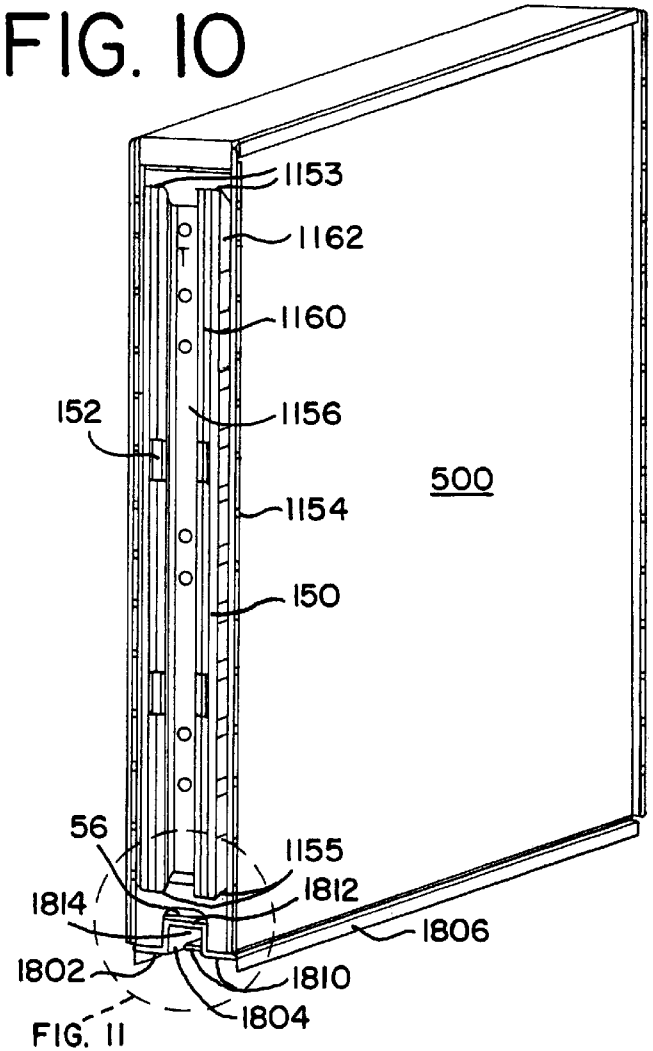
FIG. 10 is a perspective view of one embodiment of an upper wall panel having the core shown in FIG. 9.

As best shown in FIGS. 10 and 11, the bottom frame includes a downwardly opening channel 56 formed along the length thereof As with the lower wall panels, either a shell and hanger bracket are mounted to each end of the upper wall panel, with a bottom portion of the base of the shell having a cut out to provide access to the channel, or more preferably, a hanger bracket 1150 is connected to the end of the upper wall panel and includes top and bottom draw surfaces 1153, 1155 formed thereon. A portion of the bottom plate has a cut out 1166 to provide access to the channel 56. As such, each end of the upper wall panel, with its hanger bracket, is defined as having upper and lower draw surfaces. Alternatively, an upper and lower wedge block can be mounted to each end of the upper wall panel along an upper portion thereof such that the upper wall panel has upper and lower draw surfaces.

Figure 12:
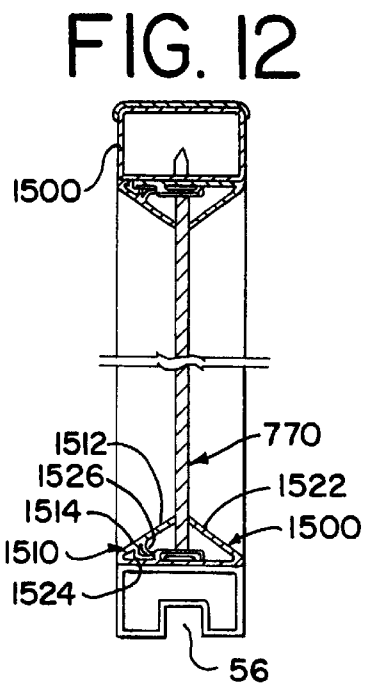
FIG. 12 is an elevated, cross-sectional view of an alternative embodiment of an upper wall panel.
Figure 13:
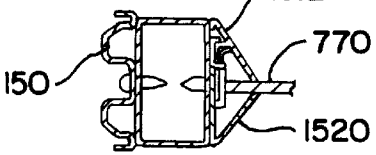
FIG. 13 is a cross-sectional view of a side frame member of the alternative embodiment of the upper wall panel shown in FIG. 12.

In an alternative embodiment of the upper wall panel, shown in FIGS. 12 and 13, a tubular frame 1500 is formed around the periphery of the upper wall panel. The frame can be made of a one-piece tube, or it can be comprised of an upper and lower horizontal frame and a pair of vertical side frames, all of which are joined at their respective ends, with fasteners or by welding, to form a rectangular frame. A pair of clips 1510, 1520, preferably made from a plastic extrusion, snap together to form a pair of inclined resilient, opposing flanges 1512, 1522. A first clip 1520 includes a recess defined in part by a rib 1524 and a resilient flange 1526. A second clip 1510 includes a flange having a rib 1514 that engages the rib 1524 of the first clip as the flange is inserted into the recess so as to join the clips in a snap fit. The first clip 1520 is mounted to an inner peripheral surface of the frame. A sheet 770 is installed between the clips, with the flanges 1512, 1522 engaging the sheet with a press fit to hold the sheet firmly to the frame. During installation, the first clip 1520 is attached to the frame with fasteners or adhesive. The sheet 770 is then disposed on the first clip 1520 with the second clip 1510 then snapped into place to hold firm the sheet to the frame. In a preferred embodiment, the sheet is transparent, and can be made of glass, acrylic, plastic or like material. Alternatively, the sheet can be non-transparent, for example, wood, metal or reflective glass. As with the first embodiment, the lower portion of the frame includes a downwardly facing channel 56 shaped to receive the upper channel 1804 of the rail. A cap can be disposed on the top of the upper wall panel to improve the aesthetics thereof.

Now referring to FIGS. 1, 2 and 4–7, an upper corner post is shown. The upper post 202*a* is of similar construction to the lower post described above with respect to FIG. 1, and includes a substantially similar cross-section as the lower post underlying the upper post. In particular, the post includes a post member configured as a tube having two, three or four connecting sides.

An insert 1600, configured in one embodiment as a tube, is shaped to be inserted inside the upper post 202*a* and is secured thereto with a plurality of fasteners 1602*b*, or by welding, adhesive or snap fit. The insert can be configured with other non-tubular cross-sections and can be extruded, roll formed or welded. The upper post 202*a* is mounted to the lower post 202 by inserting the insert 1600 into the lower post tube, which is also shaped to receive the insert and which acts as a sleeve. The insert can thereafter be attached to the lower tube if desired. It should be understood that the insert only need be attached to one or the other of the upper and lower tubes, with the other thereof slidably receiving the insert. However, the insert can be attached to both the upper and lower post-if desired to prevent the upper tube from being inadvertently removed from atop the lower post.

In one embodiment of the upper post, best shown in FIG. 1, the upper post includes an upper wedge block 220*a* mounted to each connecting side thereof with a pair of fasteners. A lower draw block 860 is mounted to each connecting side of the post along a bottom portion thereof below the upper wedge block. The lower draw block 860 includes a base 870, a pair of mounting flanges with screw holes 866 extending upwardly from the base, a draw portion having an upwardly extending draw surface 868, and an insert portion 872 extending laterally from the base.

Referring to FIGS. 1–3, 10 and 11, a rail 1800, preferably made of metal, such as steel or aluminum, and otherwise referred to as a cap member, is shown as having a hat-shaped cross section, including a pair of channels 1802, 1804, each formed with a pair of side flanges 1806, 1808 and a base portion 1810, 1812, respectively. The rail can be extruded, roll formed or otherwise assembled by welding and the like. The first channel 1804, formed as an upstanding portion, opens downwardly into the second channel at each end of the rail, as shown in FIG. 10, so as to provide access for the insert portions of each of the lower draw blocks. The channel 1804 is closed off between the open portions by the base 1810 of the lower channel so as to form a tube therebetween. Alternatively, the base can extend the entire length of the rail such that the upper channel is closed along its entire bottom and forms a tube running the length of the rail. In this embodiment, the insert portions are received in the ends of the tube.

The lower second channel 1802 is shaped to be received over the top 61 of the lower wall panel 52, and preferably has a width between the flanges 1806 substantially equal to the thickness of the wall panel. The rail 1800 is disposed on the top of the wall panel as the second channel 1802 is supported thereon with a plurality of fasteners 1815, preferably wood screws, securing the rail to the wall panel. Alternatively, the rail can be secured to the top of the lower wall panel with adhesive, staples, or like means for attachment. When the rail is attached to the lower wall panel, the first channel, with the top of the wall panel, defines an outwardly facing opening 1814 in each end of the rail.

Referring to FIG. 6, a T-shaped draw block 1000, preferably made of aluminum or like material, is shown as including a body portion 1002 and a pair of insert feet 1004 extending laterally from the body. Each insert foot 1004 is shaped to be received in the opening 1814 formed in the end of the rail 1800, with the bottom of the insert foot initially either resting on and engaging the top of the wall panel (if the base 1810 of the channel has been cut away at each end of the rail as referenced above), or the top of the channel base 1810 (if the base has not been cut away as described with respect to an alternative embodiment). At the same time, the body portion 1002 initially rests on the top of the upper draw block 110 connecting the underlying lower wall panels. As such, the rail 1800 and draw block 1000 can be installed without disassembling the connection between the lower wall panels.

The opening 1814 formed in the end of the rail also is shaped to receive the insert 872 extending laterally from the lower draw block attached to the upper post. The body 1002 includes a pair of upwardly facing draw surfaces 1006 formed on a top thereof, and further includes a post 1008, configured as an annular receiver with a threaded opening 1110 formed therein. Preferably, the draw surfaces are planar and are formed at an angle of 45 degrees to the vertical (90 degrees to each other). Alternatively, the post can be comprised as a threaded stud, depending on whether the mating draw rod is configured with a female threaded opening, or a male threaded portion. The draw block 1000 is disposed over the upper draw block 110 connecting the two lower wall panels with the opposite insert feet 1004 inserted into the facing adjacent openings 1814 formed in the ends of the respective rails attached to each of the lower wall panels such that the draw block extends between adjacent rails at the interface of the lower wall panels. Fasteners, such as screws, can be used to further secure the insert feet to the rail and/or to the underlying frame of the wall panel, although in a preferred embodiment, the insert is merely inserted into the opening wherein after it engages the rail upon being engaged with the draw rod.

To install the pair of upper wall panels as shown in the configuration of FIG. 6, a first upper wall panel 500 is disposed on top of the lower wall panel connected to the lower corner post 202. The bottom 567 of the upper wall panel is disposed on the top 61 of the lower wall panel, which is capped with the rail 1800, such that the channel 56 formed in the bottom of the upper wall panel 500 is matingly disposed on the upper rail channel 1804. Preferably, the bottommost surface 567 of the upper wall panel, formed on each side of the channel 56, is engaged with the top of the base portion 1810, with a slight gap formed between the top of the base portion 1812 and the bottom of the channel 56. Preferably, the channels 56, 1804 have complementary shapes, as best shown in FIG. 11, such that the upper wall panel is aligned over the lower wall panel and cannot be laterally dislocated out of the plane thereof as the sides of the walls forming the channel 56 engage the side flange 1808 so as to absorb any lateral loading. The interface of the channels 56, 1804 further functions as a light seal to prevent light from seeping from one side of the wall panel assembly to the other through the interface of the upper and lower wall panels.

In a preferred embodiment, the draw surfaces 155 of the hanger bracket secured to the end of the upper wall panel adjacent the upper comer post are not engaged with the draw surfaces 868 of the lower draw block attached to the comer post. Rather, the draw surfaces are slightly spaced apart to provide a clearance therebetween, e.g., preferably from about 1/64 to 1/8 inch. Similarly, the draw surfaces 1155 formed along the bottom of the hanger bracket are spaced above the draw surfaces 1006 of the draw block attached to the lower wall panel. The slightly spaced apart draw surfaces provide the appearance that the respective members are engaged and the lower draw blocks, with their complimentary draw surfaces, further function as a light seal to prevent light from seeping from one side of the wall panel assembly to the other side at the junction of the upper and lower wall panels. In this way, it should be understood that in this embodiment, the lower draw blocks 860 secured to the upper post do not function to attach to the upper wall panel to the upper post. Rather, the lower draw block 860, with its insert portion received in the opening 1814 in the end of the rail, serves to maintain the orientation of the upper post and further provides alight seal.

In an alternative embodiment, the draw surfaces of the lower draw blocks are engaged with the lower draw surfaces of the hanger brackets attached to the upper wall panels and thereby provide structural support therefor.

Referring to FIG. 6, a short draw rod 290, or bolt, is inserted through the upper draw block and tightened to draw the draw surfaces 114 of the upper draw block into engagement with the draw surfaces 228, 1153 of the upper wedge block of the upper corner post and of the hanger bracket. As the draw rod 290 is tightened, the bottom 567 of the upper wall panel is clamped against the top of the rail 1800 on top of the lower wall panel so as to compress the core of the upper wall panel 500. Similarly, the next adjacent upper wall panel can be disposed on the underlying lower wall panel with the bottom channel 56 disposed on the upstanding rail channel 1804 and with the draw surfaces 1155 of the hanger bracket spaced apart from the draw surfaces 1006 of the draw block. Again, a longer draw rod 90 is inserted through the draw block 110 as the draw surfaces 114 of the draw block are engaged with the complementary draw surfaces 1153 of the abutting hanger brackets. The draw rod 90 is threadably engaged with the lower draw block 1000 so as to clamp the bottoms 567 of the upper wall panels against the rails mounted to the tops of the lower wall panels, so as to thereby eliminate any gaps formed therebetween and any attendant seepage of light between the lower and upper wall panels. As the draw rod is tightened, the draw block 1000 is pulled slightly upward such that the tops of the insert feet 1004 are drawn against the base portion 1812 of upper rail channel 1804.

Alternatively, it should be understood that the lower draw blocks, or the hanger frames, could be configured such that the respective draw surfaces are engaged and thereby clamp the upper wall panels to the lower draw blocks, as opposed to clamping them to the top of the lower wall panels.

Figure 7:
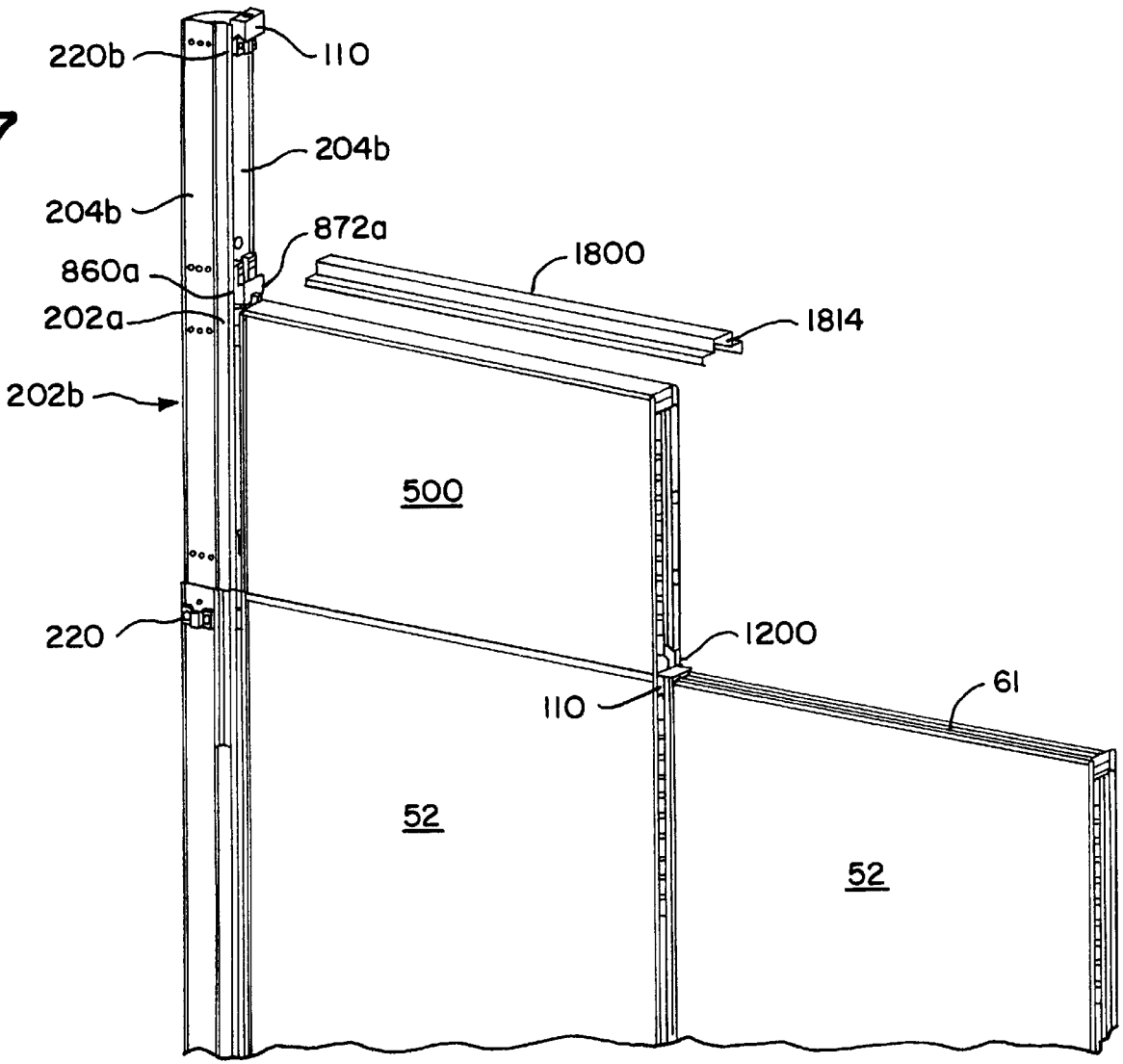
FIG. 7 is a perspective view of a double-high second post attached to a first post with an upper wall panel connected thereto.

Referring to FIGS. 1–4, an upper wall panel 500 in an end-run configuraton is shown attached to an upper corner post. In this configuration, an L-shaped lower draw block 1200, preferably made of aluminum or similar material, shown in FIGS. 6 and 7, is mounted to the rail 1800 of the underlying lower,wall panel. The draw block 1200 includes a body portion 1204, an insert foot 1202 that extends laterally from the body portion and is shaped to be received in the opening 1814 in the rail, a draw surface 1206 and a post 1208 formed as an annular receiving portion having threaded opening 1210 or bore. Alternatively, the post can be configured as a male threaded stud, depending on the configuration of the mating draw rod. The draw surface is preferably upwardly inclined at an angle of 45 degrees to the vertical and is planar.

Figure 4:
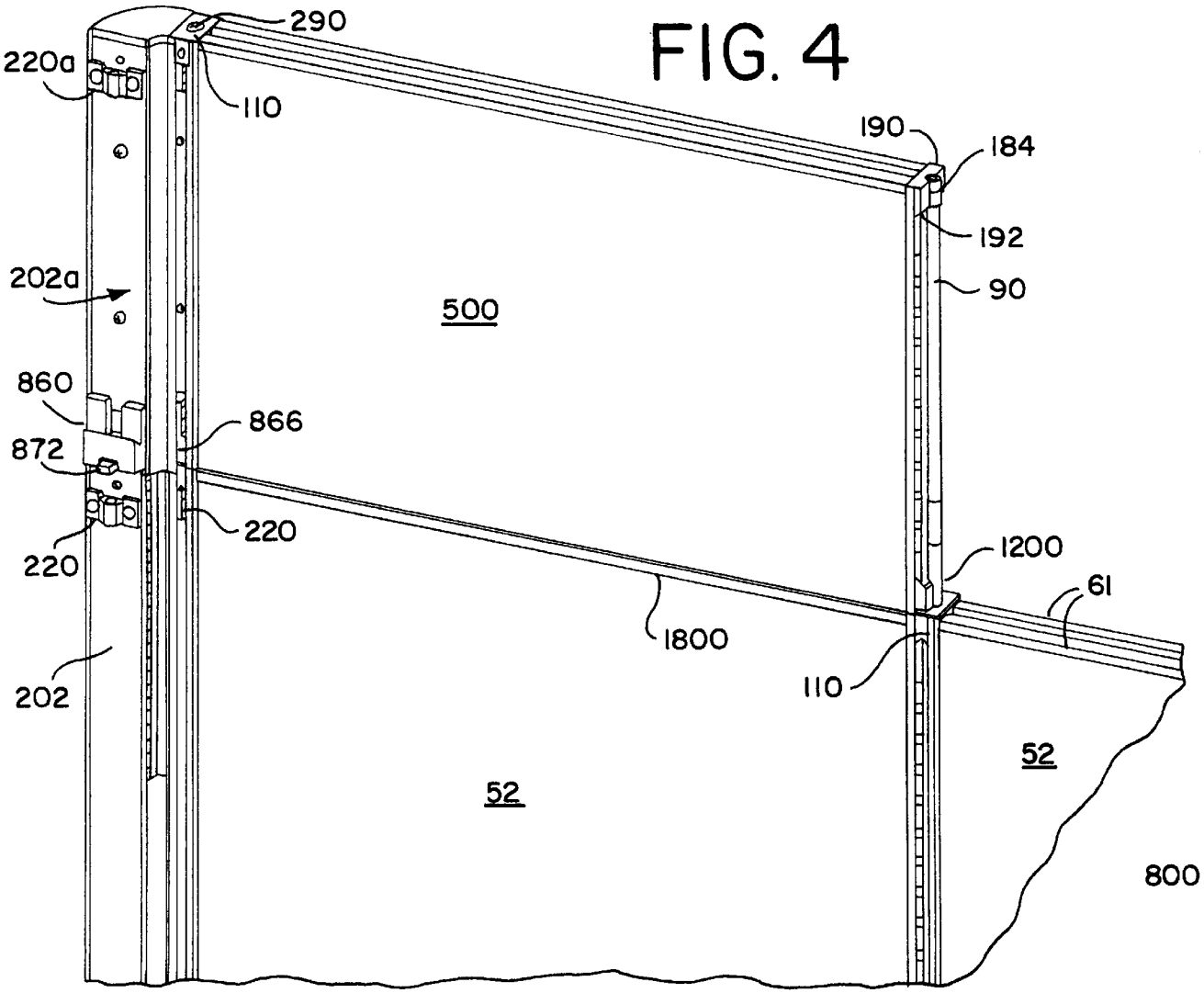
FIG. 4 is a perspective view of an upper wall panel connected to the second comer post and the lower wall panel shown in FIG. 2.

As best shown in FIG. 4, a modified upper draw block 190 includes a downwardly extending draw surface 192 and an opening 184. A draw rod 90 extends through the opening and engages the draw block as the head of the draw rod is received in a recess formed therein. The draw rod 90 is threadably engaged with the lower draw block 1200 and can be tightened to clamp the bottom 567 of the upper wall panel to the rail on top 61 of the lower wall panel as the channel of the rail 1804 is received in the channel 56 formed in the bottom of the panel. In a preferred embodiment, the draw surfaces of the hanger bracket 155 are spaced above the draw surface 1206 of the lower draw block so as to ensure that there is core compression. However, it should be understood that the hanger bracket and draw block could be positioned and/or configured so as to ensure that the draw surfaces engage, whereby the upper wall panel is clamped to the draw block.

Figure 5:
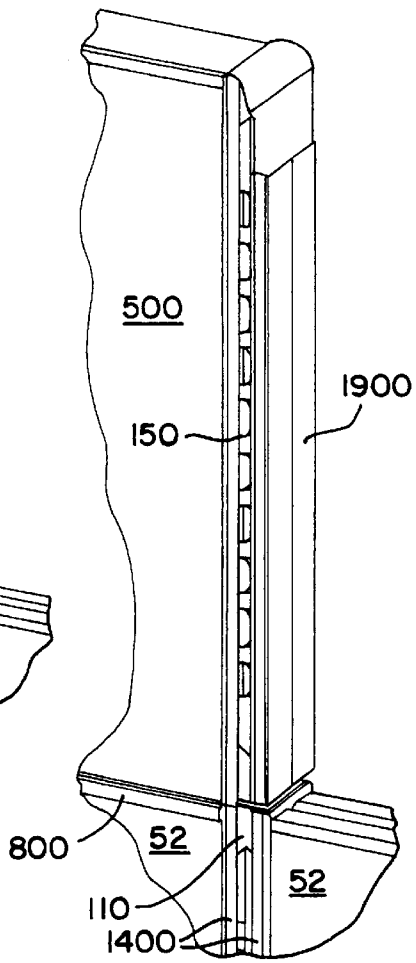
FIG. 5 is a perspective view of a cover disposed on the end of the upper wall panel shown in FIG. 4.

Referring to FIG. 5, a cover member 1900 is installed on the end of the upper wall panel over the draw rod by way of engagement with the hanger bracket. The upper wall panel with the cover attached can be connected to the draw block by inserting a draw rod 90, with attached draw block 190, through the space between the cover 1900 and the hanger bracket 1150. The draw block 1200 is then engaged by the draw rod 90. Alternatively, the cover can be installed on a clip which includes tab members that engage the end slots 152 formed in the end of the hanger bracket. The cover can be relatively shallow, or deep so as to provide a cable management passageway.

Figure 8:
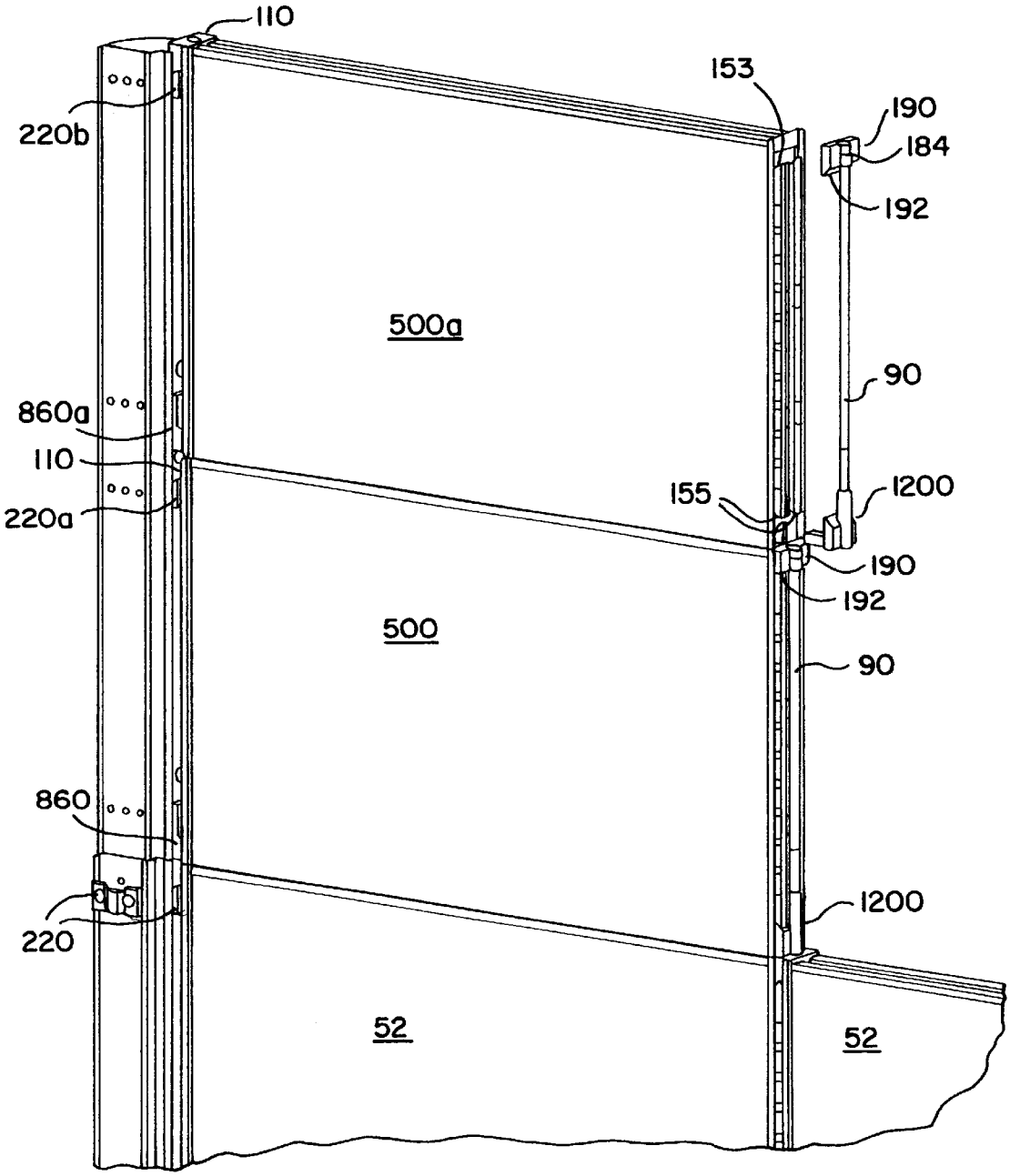
FIG. 8 is a perspective view of a pair of upper wall panels being connected in a top-to-bottom, double high configuration.

Now referring to FIGS. 7 and 8, a second embodiment of the upper post **202*b* is shown as providing for a top-to-bottom, double high configuration of stackable upper wall panels. In particular, the upper post is substantially the same as the single high upper post described above, except that the post further includes a second lower draw block 860***a* attached to connecting side 204*b* of the post above a first upper wedge block, and a second upper wedge block 220*b* attached to the connecting side above the second lower draw block 860*a*. The second lower draw block 860*a* provides a light seal. Alternatively, the second lower draw block 860*a* is not secured to the upper post, but merely rests on top of the draw block 110 disposed below it with the insert portion 872*a* received in the end of the rail 1800.

During installation, a first upper wall panel 500 is secured to the upper post and an underlying lower wall panel in the manner described above. A rail 1800 is then attached to the top of the first upper wall panel 500 in the same manner as the rail is attached to the lower wall panels. An L-shaped or T-shaped draw block is then engaged with the rail by inserting the insert foot into the opening in the end of the rail. A second upper wall panel 500*a* is then attached to the first upper wall panel with a pair of draw rods 290, 90 and a pair of upper draw blocks 110, 190 in the manner described above with respect to the first lower wall panel. In particular, the draw rod 290 connects the draw block 110 and the second upper wedge block 220*b* and the draw rod 90 connects the draw block 190 and the lower L-shaped draw block 1200 secured to the rail on top of the first upper wall panel.

Although the Figures show only a single second upper wall panel 500*a* stacked double high on a first upper wall panel 500, it should be understood that two or more second upper wall panels can be installed end-to-end on underlying first upper wall panels installed end-to-end (further installed on lower wall panels installed end-to-end) using rails, draw blocks and draw rods as described above with respect to the single-high upper wall panels. It should also be understood that the upper post could be further configured to accommodate three or more upper wall panels stacked bottom-to-top by providing three or more pairs of lower draw blocks and upper wedge blocks respectively. Likewise, additional upper wall panels, e.g., three or more, can be stacked one on top of the other in an end-to-end configuration in accordance with the aforementioned description.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A system of wall panels comprising:

a lower wall panel having a top, a bottom and opposite ends;

a rail attached to said top of said lower wall panel, said rail comprising opposite ends, each of said opposite ends defining an opening;

a lower draw block comprising an insert portion inserted in one of said openings defined in one of said ends of said rail;

an upper wall panel overlying said lower wall panel and having opposite ends and a bottom overlying said rail, said upper wall panel having a draw surface formed on each end thereof, wherein one of said opposite ends of said upper wall panel is positioned adjacent said lower draw block;

an upper draw block having at least one draw surface, wherein said draw surface of said upper draw block engages said draw surface of said upper wall panel formed on the end of said upper wall panel that is positioned adjacent said lower draw block; and a draw rod extending between and connecting said upper and lower draw blocks.

2. The system of claim 1 wherein said bottom of said upper wall panel engages said rail.

3. The system of claim 2 wherein said bottom of said upper wall panel has a channel formed therein, said channel shaped to receive said rail.

4. The system of claim 1 wherein said upper wall panel comprises a hanger bracket attached to one of said ends thereof, said hanger bracket having opposite ends, with at least one of said ends configured with said draw surface of said upper wall panel.

5. The system of claim 1 wherein said lower draw block comprises a first and second insert portion extending laterally therefrom in opposite directions.

6. The system of claim 1 wherein said upper wall panel comprises a first upper wall panel having a top, and further comprising a rail mounted to said top of said first upper wall panel, said rail mounted to said first upper wall panel having an end defining an opening, a second upper wall panel overlying said first upper wall panel and having a bottom overlying said rail mounted to said first upper wall panel and a draw surface formed along each end thereof, a second lower draw block having an insert portion inserted in said opening defined in said end of said rail mounted to said first upper wall panel, a second upper draw block having at least one draw surface engaged with said draw surface of said second upper wall panel, and a second draw rod extending between and connecting said second upper and lower draw blocks.

7. The system of claim 6 wherein said bottom of said second upper wall panel engages said rail mounted to said first upper wall panel.

8. The system of claim 7 wherein said bottom of said second upper wall panel has a channel formed therein, said channel formed in said second upper wall panel shaped to receive said rail mounted to said first upper wall panel.

9. The system of claim 1 further comprising a first post connected to one of said ends of said lower wall panel, a second post attached to said first post and extending upwardly therefrom, said second post having a draw surface and a threaded opening, a second upper draw block having a pair of draw surfaces engaging said draw surface of said second post and said draw surface of said upper wall panel formed on the end thereof adjacent said second post, and a second draw rod extending between and connecting said second upper draw block and said threaded opening.

10. The system of claim 9 wherein said second post further comprises a second draw surface and a second threaded opening and wherein said upper wall panel comprises a first upper wall panel having a top, and further comprising a rail mounted to said top of said first upper wall panel, a second upper wall panel overlying said first upper wall panel and having a bottom overlying said rail mounted to said first upper wall panel and a draw surface formed along each end thereof, a third upper draw block having a pair of draw surfaces engaging said second draw surface of said second post and one of said draw surfaces of said second upper wall panel formed on the end thereof adjacent said second post, and a third draw rod extending between and connecting said third upper draw block and said second threaded opening.

11. The system of claim 9 wherein said second post comprises a wedge block having said draw surface and said threaded opening.

12. The system of claim 1 wherein said lower wall panel comprises a first lower wall panel and said upper wall panel comprises a first upper wall panel, and wherein said lower draw block further comprises a first and second insert portion extending in opposite directions therefrom, said first insert portion inserted into said rail attached to said first lower wall panel, and further comprising a second lower wall panel having a top, a bottom and opposite ends, said second lower wall panel connected to said first lower wall panel in an end-to-end configuration, a rail attached to said top of said second lower wall panel, said rail having opposite ends, each of said ends defining an opening, said second insert portion inserted into said opening defined by one of said ends of said rail attached to said second lower wall panel, a second upper wall panel overlying said second lower wall panel and having a bottom overlying said rail attached to said second lower wall panel, said second upper wall panel having a draw surface adjacent one of said draw surfaces of said first upper wall panel, and wherein said upper draw block comprises a pair of draw surfaces, said draw surfaces engaging said adjacent draw surfaces of said first and second upper wall panels.

13. The system of claim 1 wherein said lower draw block comprise at least one draw surface and wherein said draw surface of said upper wall panel comprises an upper draw surface and said upper wall panel further comprising a lower draw surface engaging said at least one draw surface of said lower draw block.

14. The system of claim 13 wherein said upper wall panel comprises a hanger bracket mounted to said end thereof, said hanger bracket having opposite ends configured as said upper and lower draw surfaces respectively.

15. The system of claim 1 wherein said upper wall panel comprises a wedge block attached to one of said ends thereof, said wedge block configured with said draw surface of said upper wall panel.

16. A system of wall panels comprising:

a first post;

a lower wall panel connected to said first post;

a second post connected to said first post and extending upwardly therefrom, said second post having at least a first and second draw surface positioned in a spaced apart relationship along a length of said second post;

a first and second upper wall panel each having an upper draw surface formed on each end thereof; and a first and second draw block each having a pair of draw surfaces;

wherein said first upper wall panel is positioned in an overlying relationship with said lower panel with said first draw block disposed such that said pair of draw surfaces engages respectively said first draw surface of said second post and said upper draw surface formed along one of said ends of said first upper panel, and wherein said second upper wall panel is positioned in an overlying relationship with said first upper panel with said second draw block disposed such that said pair of draw surfaces engages respectively said second draw surface of said second post and said upper draw surface formed along one of said ends of said second upper panel.

17. The system of claim 16 wherein said first post comprises an upper portion configured as sleeve, and wherein said second post comprises an insert shaped to be received in said sleeve, wherein said insert is inserted into said sleeve.

18. The system of claim 16 wherein said second post comprises a first wedge block comprising said first draw surface and having a threaded opening and a second wedge block comprising said second draw surface and having a threaded opening, and further comprising a first and second draw rod, said first draw rod extending between and engaged with said first draw block and said threaded opening of said first wedge block and said second draw rod extending between and engaged with said second draw block and said threaded opening of said second wedge block.

19. A system of wall panels comprising:

a first post;

a lower wall panel connected to said first post;

a second post connected to said first post and extending upwardly therefrom, said second post having an upper and lower draw surface positioned in a spaced apart relationship along a length of said second post;

an upper wall panel having an upper and lower draw surface formed on each end of said upper wall panel; and a draw block having a pair of draw surfaces;

wherein said upper wall panel is positioned in an overlying relationship with said lower panel with said lower draw surface formed along one end of said upper wall panel engaging said lower draw surface of said second post, and wherein said draw block is positioned with one of each of said pair of draw surfaces engaging respectively the upper draw surface of said second post and the upper draw surface formed along said one end of said upper panel.

20. The system of claim 19 wherein said upper and lower draw surfaces of said second post comprise a first upper and lower draw surface and said second post further comprising a second upper and lower draw surface positioned in a spaced apart relationship along a length of said second post, with said second lower draw surface positioned above said first upper draw surface, and wherein said upper wall panel comprises a first upper wall panel, and further comprising a second upper wall panel overlying said first upper wall panel, said second upper wall panel having an upper and lower draw surface formed on each end thereof, and wherein said draw block comprises a first draw block and further comprising a second draw block with a pair of draw surfaces, wherein said second upper wall panel is positioned in an overlying relationship with said first upper wall panel with said lower draw surface formed along one end of said second upper wall panel engaging said second lower draw surface of said second post, and wherein said second draw block is positioned with one of each of said pair of draw surfaces engaging respectively the second upper draw surface of said second post and the upper draw surface formed along said one end of said second upper panel.

21. The system of claim 20 wherein said first post comprises an upper portion configured as a sleeve, and wherein said second post comprises an insert shaped to be received in said sleeve, wherein said insert is inserted into said sleeve.

22. The system of claim 19 wherein said second post comprises a threaded opening, and further comprising a draw rod engaging said draw block and threadably engaging said threaded opening so as to draw said draw surfaces of said draw block into engagement with said upper draw surfaces of said second post and said upper wall panel respectively.

23. The system of claim 19 wherein said second post comprises a lower draw block having said lower draw surface.

24. The system of claim 23 further comprising a rail attached to a top of said lower wall panel, said rail having an opening formed in an end thereof, and wherein said lower draw block comprises an insert portion shaped to be received in said opening in said rail, said insert portion disposed in said opening.

25. A system of wall panels comprising:

a lower wall panel having a top, a bottom, opposite ends and opposite sides;

a rail comprising a channel having a pair of side flanges and a base, said base of said channel disposed on said top of said lower wall panel along a length thereof with said side flanges extending downwardly along a portion of said opposite sides of said lower wall panel, and an upstanding portion extending upwardly from said channel;

an upper wall panel having a bottom and a channel formed in said bottom, said channel dimensioned to receive said upstanding portion therein, said upper wall panel disposed on said rail with said upstanding portion received in said bottom channel of said upper wall panel.

26. The system of claim 25 wherein said rail has opposite ends each defining an opening, and further comprising a lower draw block having an insert portion received in one of said openings, and wherein said upper wall panel further comprises an end having a draw surface, and further comprising an upper draw block engaging said draw surface and a draw rod extending between and connecting said upper and lower draw blocks so as to connect said upper wall panel to said lower wall panel.

* * * * *